US007862868B2

(12) United States Patent
Balestra et al.

(10) Patent No.: US 7,862,868 B2
(45) Date of Patent: Jan. 4, 2011

(54) INK-JET RECORDING MATERIAL

(75) Inventors: Corrado Balestra, Millesimo (IT); Silvia Biancolini, Cogoleto (IT); Raffaella Biavasco, Savona (IT); Danilo Ferraro, Cairo Montenotte (IT); Alessandro Gunnella, Savona (IT); Luisa Tavella, Savona (IT)

(73) Assignee: Ferrania Technologies, S.p.A., Ferrania/Cairo Montenotte (IT)

( * ) Notice: Subject to any disclaimer, the term of this patent is extended or adjusted under 35 U.S.C. 154(b) by 537 days.

(21) Appl. No.: 11/814,119

(22) PCT Filed: Jan. 13, 2006

(86) PCT No.: PCT/EP2006/000259

§ 371 (c)(1),
(2), (4) Date: Jul. 17, 2007

(87) PCT Pub. No.: WO2006/077052

PCT Pub. Date: Jul. 27, 2006

(65) Prior Publication Data

US 2008/0138544 A1 Jun. 12, 2008

(30) Foreign Application Priority Data

Jan. 19, 2005 (IT) ..... SV2005A0003

(51) Int. Cl.
*B41M 5/40* (2006.01)

(52) U.S. Cl. ..... 428/32.28; 428/32.34; 428/32.38; 428/195.1; 428/331

(58) Field of Classification Search ..... 428/32.28, 428/32.34, 32.38, 195.1, 331
See application file for complete search history.

(56) References Cited

U.S. PATENT DOCUMENTS

| | | | | |
|---|---|---|---|---|
| 6,419,356 | B1 * | 7/2002 | Sadasivan et al. | 347/105 |
| 6,475,612 | B1 | 11/2002 | Knight et al. | |
| 6,579,598 | B2 * | 6/2003 | Tokunaga et al. | 428/32.22 |
| 2005/0158489 | A1 * | 7/2005 | Nagata et al. | 428/32.38 |

FOREIGN PATENT DOCUMENTS

| | | | |
|---|---|---|---|
| EP | 0636489 | A1 | 1/1995 |
| EP | 0813978 | A1 | 6/1997 |
| EP | 0875544 | A1 | 4/1998 |
| EP | 1008457 | A1 | 6/2000 |
| EP | 1031431 | A2 | 9/2000 |
| EP | 1112962 | A2 | 7/2001 |
| EP | 1120281 | A1 | 8/2001 |
| EP | 1134087 | A2 | 9/2001 |
| EP | 1186439 | A1 | 3/2002 |
| EP | 1352754 | A2 | 10/2003 |
| EP | 1422071 | A1 | 5/2004 |
| GB | 1265 550 | | 3/1972 |
| JP | 61-146591 | | 7/1986 |
| JP | 05-239389 | | 9/1993 |
| JP | 11-245504 | | 9/1999 |
| JP | 11-315234 | | 11/1999 |
| JP | 2000-247015 | | 9/2000 |
| WO | WO 02/055618 | A1 | 7/2002 |
| WO | WO 2004/065130 | A1 * | 8/2004 |

OTHER PUBLICATIONS

"Effect of Precipitation and Aging on Porous Structure of Aluminium Hydroxide, Statistical Treatment of Experimental Data", Rocek, J. et al., Collect. Czech. Chem. Commun., vol. 56, 1991, pp. 1253-1262.
Porous Structure of Aluminium Hydroxide and Its Content of Pseudoboehmite, Rocek, J. et al., Applied Catalysis, vol. 74, 1991, pp. 29-36.

* cited by examiner

*Primary Examiner*—Betelhem Shewareged
(74) *Attorney, Agent, or Firm*—Robert C. Haldiman; Husch Blackwell LLP

(57) ABSTRACT

The present invention refers to an ink-jet recording material comprising a support, and at least one ink receiving porous layer coated on the support, wherein at least one porous layer comprises, dispersed therein, an organic solvent having a logP value higher than 2.00, an antifading compound, a non-ionic surfactant having low EDLB, an anionic surfactant, and a carboxylic derivative.

45 Claims, No Drawings

INK-JET RECORDING MATERIAL

FIELD OF THE INVENTION

The present invention refers to an ink-jet recording material comprising a support, and at least one ink receiving porous layer coated on said support. In particular, in the material of the present invention, the porous layer comprises, dispersed therein, an organic solvent having a logP value higher than 2.00, an antifading compound, a non-ionic surfactant having low HLB, an anionic surfactant, and a carboxylic derivative.

BACKGROUND OF THE ART

In recent years, the use of ink-jet system to generate images has rapidly growth. The improvement in both printers and ink-jet recording media performances allows to obtain images similar to conventional silver halide photographic ones. At the same time, due to spreading speed increase in printing systems, there is the need to use recording media able to absorb all ink volumes in very short time. The ink high speed absorptivity can be achieved using an ink-jet recording material comprising a porous layer which is able to rapidly remove the fresh spread ink from the surface of the material, while the absorption capacity can be adjusted varying the thickness of the receiving layer.

Even if the ink-jet record materials having porous layers present a better ink absorptivity than ink-jet record materials utilizing swelling system layers, the images printed on porous system may suffer of oxidation deterioration of coloring matter component under natural air exposure. The gas circulation in porous materials supplies a continuous flux of oxidizing compounds, such as nitrogen oxides, sulfur oxides, oxygen or ozone gas, that are directly in contact with the coloring matter in the porous layer. Accordingly, images obtained by ink-jet recording materials have inferior properties in terms of storage characteristics, such as light resistance, water resistance and gas resistance, compared to images obtained by silver halide photographic materials.

The use of conventional antioxidant compounds provides a limited protection in the time that is vanished when the compound is consumed. Most of natural or synthetic antioxidants, like vitamin C, vitamin E, substituted hydroquinone, exhibit positive activity to prevent image discoloration due to oxidation, but have the disadvantage of generating colored substances, as reaction products, that visibly modify the printed image.

Various attempts have been done in the art to solve this color fading problem; in some cases, a color fading inhibitor compound has been added to the ink composition (hereinafter antifading compound). European Patent 875,544, for example, discloses an ink composition comprising a colorant, water, a water-soluble organic solvent, and a fine particle of a polymer, the polymer constituting the fine particle having a film-forming property and, at the same time, an ultraviolet absorbing capacity and/or a light stabilizing capability; Japanese Patent application 11-315,234 discloses an ink composition containing a triazine compound and a sterically hindered amine compound; Japanese Patent application 05-239,389 discloses a recording liquid comprising a dye, pure water and a light stabilizer capable of obtaining high-grade stabilized images.

As other kind of solution, a transferring protective covering material comprising a fluorescent whitening agent, an ultraviolet light absorber, and a light stabilizer to cover a printed image is disclosed in U.S. Pat. Nos. 4,756,963; 5,954,906 discloses a transferring protective covering material comprising a flexible substrate, an adhesive layer containing a light stabilizer and a solid resin layer. EP 1,186,439 discloses a surface treatment method for recorded matter, such as images recorded on a recording medium and the recording medium that contains such images, which can improve the weather characteristics of the images, such as light resistance and gas resistance. This method is characterized by subjecting the recorded matter to an after-treatment, such as spray treatment, coating treatment, immersion treatment, to form an overcoat layer applied onto the surface of the recorded matter. This overcoat layer contains an aqueous solution containing a water-soluble resin, a light resistance improving agent and an ink fixing agent; the overcoat layer protects the surface of the recorded matter preventing the gas present in the air to penetrate into the recorded matter, and thus improving the color fading due to light and gas presence. On the other hand, a re-wet liquid solution applied to a dried porous basecoat is disclosed, for example, in U.S. Pat. Nos. 6,475,612, 6,432,523 and 6,423,375, wherein a process that allows the production of multi-layer ink-receiving materials in which one or more topcoats can be applied to a porous basecoat comprising a plurality of pores to produce a uniform and defect-free coating layer is disclosed. However, both the after-treatment solution and the re-wetting solution described above involve the use of a treatment agent; this means that the treatment agent must be incorporated into an additional composition to form the protective layer to be sprayed or coated onto the surface of the recorded matter, before or after that he image is obtained, with the consequent problems related to choose the proper elements contained in the additional composition, how to introduce and mix them, how to store and treat the final composition, and so on.

Hence, it would be preferable to add the antifading compounds directly into the recording elements, without the need to prepare any additional compositions to be sprayed or coated onto the recorded matters. Many patents in the art disclose recording elements wherein ink-receiving layers contain chemical compounds to prevent color discoloration. EP 1,120,281 discloses an ink-jet recording material comprising pigment particles dispersed in a binder with average particle size of 1 micron or less. The ink receiving layer comprises light resistant enhancing agents for image selected from phenolic compounds, boric acid, borate salts and cyclodextrin compounds. EP 1,008,457 and U.S. Pat. No. 6,391,428 disclose an ink-jet recording sheet having an image preserving layer comprising anionic colloidal silica and zinc oxide particles; the ink receiving layer also comprises specific sterically hindered amines compounds having alkoxy groups. For example, WO 2002-055,618 discloses the use of specific water soluble sterically hindered amine compounds which contain an oxyl or hydroxyl group on the nitrogen atom; EP 1,031,431 discloses a recording medium comprising a specific sterically hindered amine compound having an alkyl group bonded to nitrogen atom of a piperidine ring with interposition of oxygen; EP 1,134,087 discloses a recording medium comprising an ink receiving layer containing specific sterically hindered amine compounds exhibiting solubility in water of 0.01 to 5%; Japanese Patent applications 61-146,591; 11-245,504 and 2000-247,015 describe recording sheets containing specific sterically hindered amine compounds which show improved light fastness and water resistance.

However, inkjet receiving materials containing antifading compounds incorporated in the same layers containing filler, such as alumina hydrate or silica compounds, cannot be obtained due to the interactions between the antifading compounds and the filler compounds that cause incompatibilities during coating process and unacceptable coating defects.

In spite of the number of tentative solutions in the art, there is still the need to have an ink-jet recording material which improves weather storage characteristics over time, such as air resistance, preventing oxidation deterioration of coloring matter component of the printed image during long term exposure to natural air, without causing coating problems and coating defects.

SUMMARY OF THE INVENTION

The present invention refers to an ink-jet recording material comprising a support, and at least one ink receiving porous layer coated on the support, wherein at least one porous layer comprises, dispersed therein, an organic solvent having a logp value higher than 2.00, an antifading compound, a non-ionic surfactant having low HLB, an anionic surfactant, and a carboxylic derivative.

The antifading compounds are useful to improve the weather storage characteristics during time, such as air resistance, preventing oxidation deterioration of coloring matter components of the printed image during long term exposure to natural air. Moreover, the ink-jet recording material of the present invention allows to obtain color printed images which are not altered over time.

The specific combination of the surfactants and the carboxylic derivative of the present invention allows to incorporate the antifading agent in the microporous layer without generating incompatibilities during the coating process, with a good emulsion stability of the organic solvent emulsion and without any crystallization of the antifading agent, and to get an ink-jet recording material having an excellent coating quality and an optimal glossyness.

DETAILED DESCRIPTION OF THE INVENTION

The antifading compounds useful in the ink-jet receiving material of the present invention are chosen from the group comprising hydroquinone and derivatives thereof, alcoxyphenols, dialcoxyphenols, phenols and derivatives thereof, anyline and derivatives thereof, amines and derivatives thereof, indane and derivatives thereof, chromane and derivatives thereof, alcoxyanylines, and heterocycles, and metal organic complexes. Derivatives of sterically hindered amines and phenols are particularly useful. Preferably, the antifading compounds useful in the present invention are represented by the following Formula I Formula I

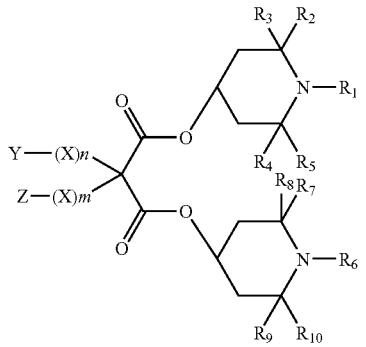

wherein $R_1$ to $R_{10}$, being the same or different, each is an alkyl group having from 1 to 5 carbon atoms; X is a divalent linking group; m and n, equal or different, are 0, 1 or 2; Z is Y or is an alkyl group having from 1 to 12 carbon atoms, and Y is represented by formula II, Formula II

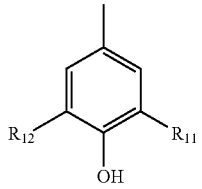

wherein $R_{11}$ and $R_{12}$ each being an alkyl group having from 1 to 6 carbon atoms.

In previous Formula I, $R_1$, to $R_{10}$, being the same or different, each represents a straight or branched alkyl group having from 1 to 5 carbon atoms, such as, for example, methyl group, trifluoromethyl group, ethyl group, propyl group, isopropyl group, butyl group, tert.-butyl group. Preferred examples of alkyl groups represented by $R_1$, to $R_{10}$ are methyl groups or ethyl groups.

X, when present, is a divalent linking group, such as, for example, alkylene groups with straight, branched or cyclic chain, arylene groups, aralkylene groups, oxy, oxo, thio, sulfonyl, sulfoxy, amino, imino, sulfonamido, carbonamido, carbonyloxy, urethanylene and ureylene and combinations thereof such as sulfonamidoalkylene or carbonamidoalkylene; m and n, equal or different, are 0, 1 or 2. Preferred examples of divalent linking groups are alkylene groups.

Z can be represented by Formula II or by an alkyl group having from 1 to 12 carbon atoms, such as, for example, methyl group, trifluoromethyl group, ethyl group, propyl group, isopropyl group, butyl group, tert.-butyl group, pentyl group, octyl group, nonyl group. Preferred examples of alkyl groups represented by Z are alkyl groups having from 1 to 6 carbon atoms.

In previous Formula II, $R_{11}$ and $R_{12}$, being the same or different, each represents a straight or branched alkyl group having from 1 to 6 carbon atoms, such as, for example, methyl group, trifluoromethyl group, ethyl group, propyl group, isopropyl group, butyl group, tert.-butyl group, pentyl group, hexyl group. Preferred examples of alkyl groups represented by $R_{11}$ and $R_{12}$ are methyl groups, ethyl groups, butyl group or tert.-butyl groups.

More preferred antifading compounds useful in the present invention are represented by the following Formula III:

Formula III

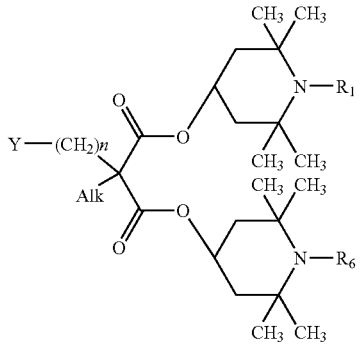

wherein, Y, $R_1$ and $R_6$ are as above and Alk is an alkyl group having from 1 to 12 carbon atoms, such as, for example, methyl group, trifluoromethyl group, ethyl group, propyl group, isopropyl group, butyl group, tert.-butyl group, pentyl group, hexyl group. Preferred examples of alkyl groups represented by Alk are alkyl groups having from 1 to 6 carbon atoms, such as, for example are methyl groups, ethyl groups, butyl group or tert.-butyl groups.

Examples of antifading compounds particularly useful in the present invention are represented by but not limited to the following examples.

Compound (1)

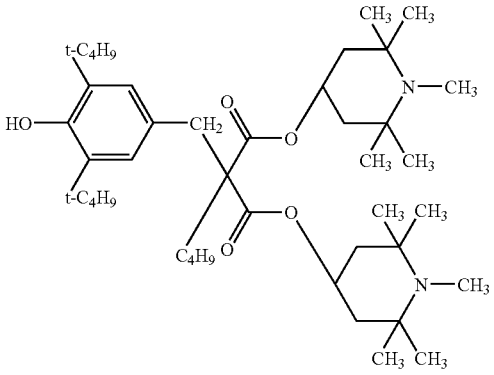

Compound (2)

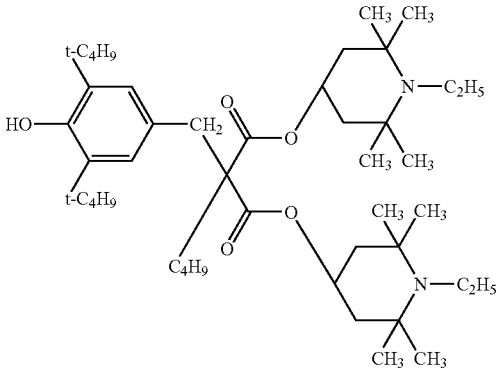

Compound (3)

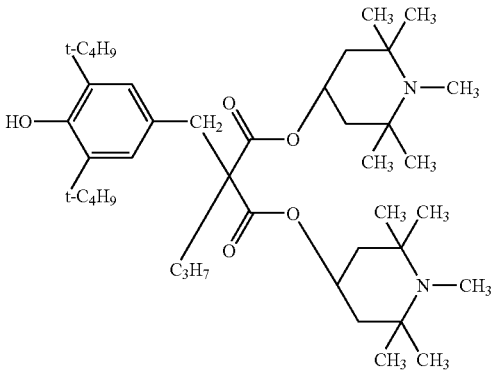

-continued

Compound (4)

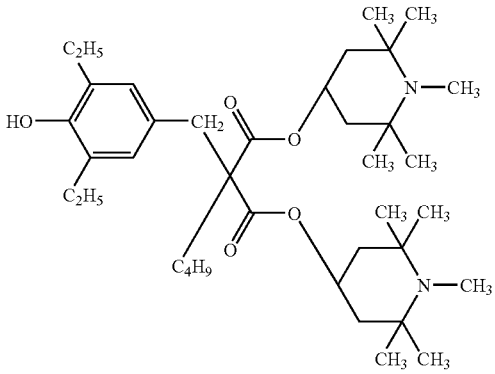

Compound (5)

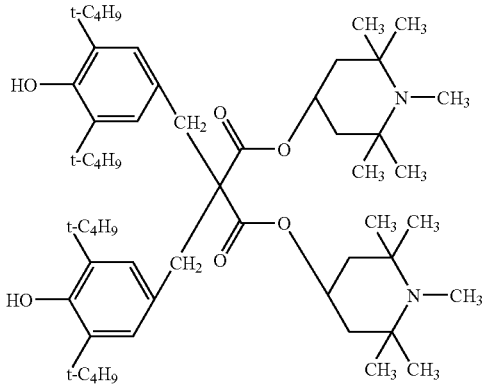

Compound (6)

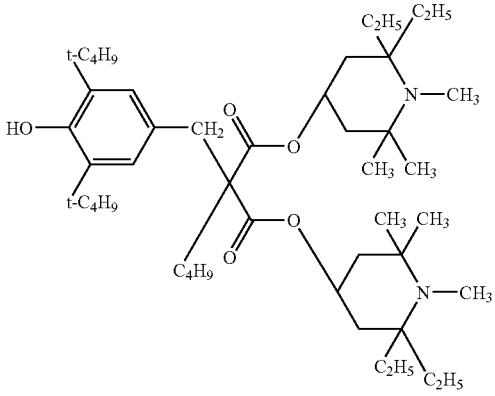

The above mentioned preferred antifading compounds can be used alone or in combination with other antifading compounds previously described. The above mentioned antifading compounds are commercially available under the trade name Tinuvin, Chimassorb, Irganox, Irgafos, Sanol, Ultranox, Irgacor, and Irgaperm (all trademarks of Ciba-Geigy Corporation, Hawthorne, N.Y.), Cyasorb (a trademark of Cytec Industries), Uvinul (a trademark of BASF Corporation, Germany).

The non-ionic surfactants having a low HLB useful in the present invention are preferably chosen from those having a HLB equal to or lower than 10. The HLB value (Hydrophilic-Lipophilic Balance) is a measure of the emulsioning capacity of a surfactant and is related to the molecular polarity. The higher the HLB value, the higher the hydrophylicity of the molecule under consideration. More details on the definition of HLB can be found in M. J. Schick, Sufactant Science Series, Vol. 1, Nonionic Surfactants, Chapter 18, M.Dekker Inc., New York, 1967. Non-ionic surfactants having a low HLB useful in the present invention can be preferably chosen among non-ionic surfactants known in the art, such as, for example, polyoxyalkylene ethers and esters, alkylenoxide polymers and copolymers, hydroxyalkyl-alkylamines, and sorbitan derivatives. In the present invention, one or more non-ionic surfactants having a low HLB can be used. Irrespectively from the number of non-ionic surfactants to be used, the HLB value of the mixture must be low, preferably equal to or lower than 10. Examples of non-ionic surfactants having a low HLB particularly useful in the present invention are represented by the following non-limiting examples.

| Trademark | Formula | HLB |
|---|---|---|
| Pluronic ® L-31 | Block copolymer PEO/PPO | 6-7 |
| Pluronic ® L-61 | Block copolymer PEO/PPO | 4 |
| Pluronic ® L-62 | Block copolymer PEO/PPO | 5 |
| Pluronic ® L-121 | Block copolymer PEO/PPO | 1 |
| Pluronic ® L-122 | Block copolymer PEO/PPO | 2 |
| Pluronic ® L-123 | Block copolymer PEO/PPO | 7 |
| Brij ® 30 | PEO (4) Laurylether | 9.7 |
| Brij ® 52 | PEO (2) Cetylether | 5.3 |
| Brij ® 93 | PEO (2) Oleylether | 4.9 |
| Brij ® 72 | PEO (2) Stearylether | 4.9 |
| Maypeg ® 200DO | PEO (200) Dioleate | 5.0 |
| Maypeg ® 400DO | PEO (400) Dioleate | 8.5 |
| Maypeg ® 400DS | PEO (400) Stearate | 8.8 |
| Span ® 20 | Sorbitol monolaurate | 8.6 |
| Span ® 40 | Sorbitol monopalmitate | 6.7 |
| Span ® 60 | Sorbitol monostearate | 4.7 |
| Span ® 65 | Sorbitol tristearate | 2.1 |
| Span ® 80 | Sorbitol monooleate | 4.3 |
| Span ® 85 | Sorbitol trioleate | 1.8 |
| Ethomeen ® S/12 | Bis(2-hydroxylethyl)soyaalkylamine | 10.0 |
| Ethomeen ® 18/12 | Bis(2-hydroxyethyl)octadecylamine | 9.8 |
| Ethomeen ® O/12 | Bis(2-hydroxyethyl)oleylamine | 9.9 |

Pluronic® is a registered trademark of BASF, Parsippany, N.J.; Brij® is a registered trademark of ICI Americas, Wilmington, Del.; Maypeg® is a registered trademark of PPG Industries, Gurnee, Ill.; Span® is a registered trademark of ICI Americas, Wilmington, Del., Ethomeen® is a registered trademark of Akzo Nobel, Arnhem, the Netherlands.

The anionic surfactants particularly useful in the present invention are represented by alkylsulfates, alkylsulfonates, alkylarylsulfates, alkylarylsulfonates, arylalkylsulfates, arylalkylsulfonates, alkylensulfates, alkylensulfonates, and dialkylsulfosuccinates. The hydrocarbon chain preferably comprises from 8 to 32 carbon atoms and can be linear or branched. These anionic surfactants are well known in the art and are described, for example, in A. W. Schwartz and J. W. Perry, Surface Active Agents, Interscience Publications. Non limiting examples of anionic surfactants includes sulfates and sulfonates of primary and secondary aliphatic alcohols having linear or branched chain with at least 8 carbon atoms and the ethoxylated derivatives thereof, the sulfonated monoglycerides, the sulfonated monoethanolamides and the ethoxylated derivatives thereof. Non limiting examples of anionic surfactants useful in the present invention are listed hereinbelow:

$C_{12}H_{25}OSO_3Na$
$C_{14}H_{29}OSO_3Na$
$C_{12}H_{25}SO_3Na$
$C_{14}H_{29}SO_3Na$
$C_{18}H_{37}SO_3Na$
$C_{18}H_{37}OSO_3Na$

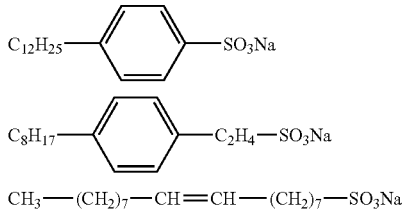

These compounds and other sulfated and solfonated anionic surfactants are compounds commercially available under the trade name of Hostapur® (a trademark of Clariant International Ltd, Switzerland), Rhodapon® (a trademark of Rhône-Poulenc), Stepanol®, Steol®, Cedepal® and Stepanate® (all trademarks of Stepan Company, Illinois), Nekal® (a trademark of BASF AG, Ludwigshafen, Germany), Aerosol® (a trademark of Cytec Industries Inc., West Paterson, N.J.), Maprofix® (a trademark of Onyx Chemical Company, Jersey City, N.J.).

The carboxylic derivatives useful in the present invention are aromatic or aliphatic organic compounds bearing as substituent at least a carboxylic group (—COOH), preferably slightly soluble in water (solubility lower than 5%, preferably lower than 1%) and with a number of carbon atoms equal to or higher than 8. e con un numero di atomi di carbonio uguale o superiore a 8. The carboxylic derivatives particularly useful in the present invention are preferably represented by the following general formula:

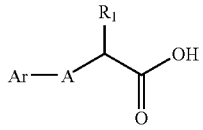

wherein $R_1$ represents hydrogen atom, or a linear or branched alkyl group having from 1 to 12 carbon atoms, A represents —O—, —S— or —$SO_2$—, and Ar represents an aryl group.

Particularly preferred examples of carboxylic derivatives useful in the present invention are represented, but not limited, by the following examples.

(F-1)

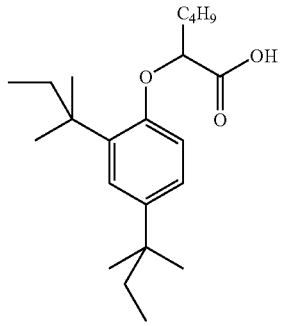

-continued (F-2)

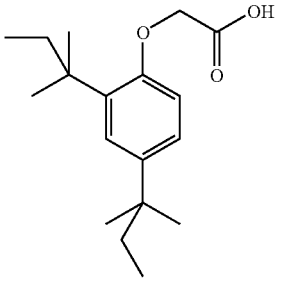

(F-3)

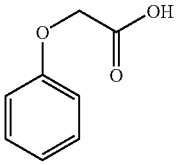

(F-4)

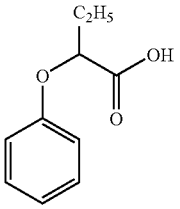

(F-5)

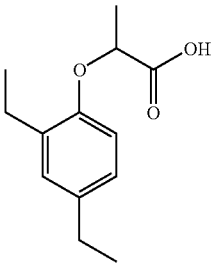

(F-6)

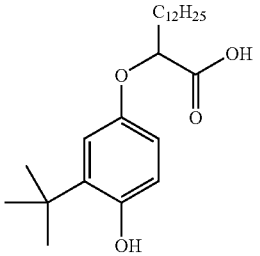

(F-7)

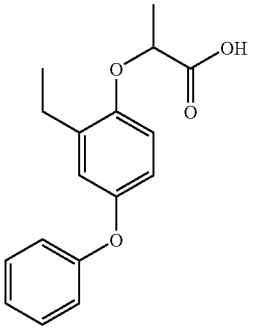

-continued (F-8)

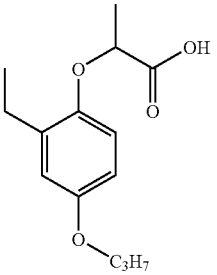

(F-9)

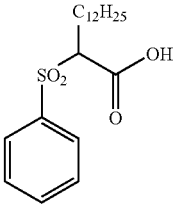

(F-10)

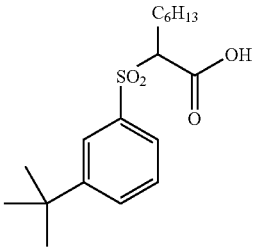

The antifading compounds useful in the present invention have a solubility in water lower than 0.01%. They are incorporated into the porous layer of the ink-jet recording material of the present invention by first dissolving the antifading compound in an organic solvent having a logp value higher that 2.00, and by then incorporating the resulting emulsion into the porous layer. In order to improve the emulsion stability, to favor the solubilization of the antifading compounds and to avoid the crystallization thereof, the emulsion of the antifading compound in the organic solvent comprises the above mentioned non-ionic surfactants having low HLB, anionic surfactants, and carboxylic derivatives.

The degree of hydrophobicity of an organic solvent can be correlated with its octanol/water partition coefficient P. The octanol/water partition coefficient of a compound is the ratio between its equilibrium concentration in octanol and in water. An organic solvent with a greater partition coefficient P is considered to be more hydrophobic. Conversely, an organic solvent with a smaller partition coefficient P is considered to be more hydrophilic. Since the partition coefficients of the organic solvents normally have high values, they are more conveniently given in the form of their logarithm to the base 10, logP. Thus the organic solvents used in this invention have a logP value higher than 2.00, preferably in the range of from 2.00 to 9.00, and more preferably in the range of from 2.00 to 6.00.

The logP values of many organic solvents have been reported. However, the logP values are most conveniently calculated by several software program, such as, for example, "LogP" from Advanced Chemistry Design Inc., "CLOGP" and "Bio-Loom" from Biobyte, Claremont, Calif., USA, "ACDLOGP" from Advanced Chemistry Developments, Toronto, Canada, or "KOWWIN" from the U.S. Environmental Protection Agency. The calculated logp value is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990). The fragment approach is based on the chemical structure of each organic solvent, and takes into account the numbers and types of atoms, the atom connectivity, and chemical bonding. The calculated logP values, which are the most reliable and widely used estimates for this physicochemical property, are used instead of the experimental logP values in the selection of organic solvents which are useful in the present invention.

Organic solvents having a calculated logp value higher than 2.00 useful in the present invention can be, for example, alkyl substituted phenols, esters of aromatic carboxylic acids with alcohols, esters of aromatic carboxylic acids and polyols, amides of aromatic carboxylic acid and aliphatic amines, and amides of aliphatic carboxylic acid and aromatic amines.

The preferred organic solvents useful in the present invention can be represented by the following Formulas IIa, IIb, IIc, and IId:

IIa

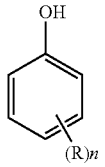

wherein R is a linear or branched alkyl group having from 1 to 10 carbon atoms, and n in an integer from 1 to 5, IIb

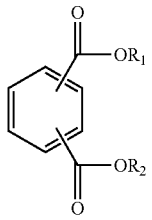

wherein $R_1$ and $R_2$, equal or different, are linear or branched alkyl groups having from 2 to 25 carbon atoms, IIc

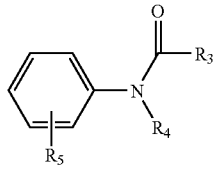

wherein $R_3$, $R_4$ and $R_5$, equal or different, are linear or branched alkyl groups having from 1 to 20 carbon atoms, and IId

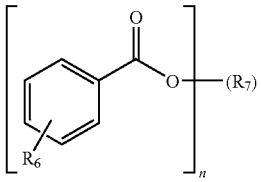

wherein $R_6$ is a linear or branched alkyl group having from 1 to 10 carbon atoms, $R_7$ is a n-valent linear or branched alkylene group having from 1 to 20 carbon atoms, and n is an integer from 2 to 4.

Useful organic solvents represented by formula IIa above are in particular di- or trialkylphenols, the alkyl groups of which together contain at least 4 carbon atoms, such as, for example 2,6-diethylphenol, 2-ethyl-4-propylphenol, 2,6-dipropylphenol, 2,6-diisopropylphenol, 2,4-dibutylphenol, 2-tert-butylphenol, 2,4-di-tert-butylphenol, 2,6-dibutylphenol, 2,6-di-tert-butylphenol, 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-sec-butylphenol, 2,6-dicyclopentyl-4-methylphenol, 2-tert-butyl-4,6-dimethylphenol, 2,4-di-tert.-amylphenol, 2,6-di-tert.-amylphenol, 2,6-di-tert-amyl-4-methylphenol, 2-tert-amyl-4,6-dimethylphenol, 2,6-di-tert-amyl-4-ethylphenol, 2,6-di-tert-amyl-4-n-butylphenol, 2,6-di-tert-amyl-4-isobutylphenol, 2,6-dicyclopentyl-4-methylphenol, 2-tert-amyl-4,6-dimethylphenol, 2,6-dioctadecyl-4-methylphenol, 2,4,6-tricyclohexylphenol, 2,6-di-tert-amyl-4-methoxymethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6-(1'-methylundec-1'-yl)phenol, 2,4-dimethyl-6-(1'-methylheptadec-1'-yl)phenol, 2,4-dimethyl-6-(1'-methyltridec-1'-yl)phenol.

Useful organic solvents represented by formula IIb above are in particular alkyl phthalates, the alkyl groups of which together contain at least 4 carbon atoms, such as, for example, dibutyl phthalate, diundecyl phthalate, bis(2-ethylhexyl) phthalate, dioctylphthalate, dicyclohexylphthalate, bis(2-ethylhexyl)phthalate, decylphthalate, bis(2,4-di-tert-amylphenyl)isophthalate, and bis(1,1-diethylpropyl)phthalate), and the like.

Useful organic solvents represented by formula IIc above are in particular phenylalkylamides, such as, for example, N-methyl-N-phenylacetamide, N-propyl-N-phenylacetamide, N-butyl-N-phenylacetamide, N-methyl-N-phenylpropionamide, N-propyl-N-phenylpropionamide, N-isobutyl-N-phenylpropionamide, N-butyl-N-phenylhexanoamide, N-methyl-N-(4-methylphenyl)acetamide, N-isopropyl-N-(4-methylphenyl)acetamide, and the like.

Useful organic solvents represented by formula IId above are in particular 1,3-propanediol-dibenzoate, 1,4-butanediol-dibenzoate, 1,3-butanediol-dibenzoate, 1,5-pentanediol-dibenzoate, 1,4-butanediol-2-methyl-dibenzoate, 1,2,3-propanetriol-tribenzoate, 1,3-propanediol-2,2-dimethyl-dibenzoate, pentaerythritol-tetrabenzoate, 1,4-butanediol(2-hydroxymethylbenzoate)-dibenzoate, pinacol-dibenzoate, and the like.

The calculated logP values of several organic solvents useful in the present invention are reported in the following table.

| Organic solvent | LogP Value |
|---|---|
| 2,6-diisopropylphenol | 2.97 |
| 2-tert-butylphenol | 3.42 |
| 2,4-di-tert-amylphenol | 6.31 |
| 2,6-di-tert-butyl-4-sec-butylphenol | 6.43 |
| Dibutyl phthalate | 4.61 |
| Dicyclohexyl phthalate | 6.20 |
| Bis(2-ethylhexyl) phthalate | 8.39 |
| 1,3-propanediol-2,2-dimethyl-dibenzoate | 4.68 |
| N-butyl-N-phenylacetamide | 2.40 |
| N-butyl-N-phenylhexanoamide | 4.36 |

The LogP values shown in the table above are calculated by using the KOWWIN™ v.1.66 software (owned by the U.S. Environmental Protection Agency).

When in the present invention the term "group" is used to define a chemical compound or substituent, the described chemical material comprises the basic group, ring or residue and that group, ring or residue with conventional substitutions. When on the contrary the term "units" is used, only the chemical unsubstituted material is intended to be included. For instance, the term "alkyl group" comprises not only those alkyl units such as methyl, ethyl, butyl, octyl, stearyl, etc., but even those units bearing substituents such as halogen atoms, cyano, oxydryl, nitro, amino, carboxilate, solfate or solfonate groups. The term "alkyl units" on the contrary comprises only methyl, ethyl, stearyl, cyclohexyl.

In the process of incorporating the antifading compounds into the porous layer by using organic solvents, different procedures may be satisfactory followed. According to one procedure, the antifading compound, the non-ionic surfactant having low HLB, and the carboxylic derivative are first dissolved in the water-immiscible organic solvent. A low boiling auxiliary solvent, such as, for example, ethyl acetate, toluene, methanol, tetrahydrofuran, and the like, can be used to facilitate and/or improve the dissolution of the mixture and/or to reduce the viscosity of the solution. The obtained organic solvent solution is then added to an aqueous solution of a hydrophilic colloid binder comprising the anionic surfactant, and the mixture is emulsified by means of dispersing apparatus (such as a colloidal mill, a homogeneyzer and the like. The obtained emulsion is then added to the coating composition which is used for forming the porous layer. Alternatively, it may be advantageous to incorporate the organic solvent solution of the antifading compound together with the non-ionic surfactant having low HLB, the anionic surfactant, and the carboxylic derivative directly into the coating composition used for forming the porous layer and dispersing the mixture.

The amount of the antifading compound comprised in the porous layer of the material of the present invention is generally in the range from 0.1 to 10.0 g/m$^2$, preferably from 0.3 to 4.0 g/m$^2$, and most preferably from 0.5 to 3.0 g/m$^2$. The amount of the organic solvents comprised in the porous layer used in the present invention is generally in the range from 0.1 to 20.0 g/m$^2$, preferably from 0.2 to 10.0 g/m$^2$, most preferably from 0.5 to 5.0 g/m$^2$.

The amount of the non-ionic surfactant having low HLB comprised in the porous layer of the material of the present invention is generally in the range from 0.10 to 1.00 g/m$^2$, preferably from 0.20 to 0.80 g/m$^2$, and most preferably from 0.30 to 0.70 g/m$^2$.

The amount of the anionic surfactant comprised in the porous layer of the material of the present invention is generally in the range from 0.01 to 1.00 g/m$^2$, preferably from 0.02 to 0.50 g/m$^2$, and most preferably from 0.05 to 0.20 g/m$^2$.

The amount of the carboxylic derivative comprised in the porous layer of the material of the present invention is generally in the range from 0.10 to 10.00 g/m$^2$, preferably from 0.50 to 5.00 g/m$^2$, and most preferably from 1.00 to 3.00 g/m$^2$.

The inorganic pigment fine particles comprised in the ink receiving porous layer may be inorganic pigment fine particles which are insoluble or hardly soluble in water. Specifically, the inorganic pigment fine particles can be exemplified by inorganic pigments such as calcium carbonate, kaolin, talc, calcium sulfate, barium sulfate, titanium dioxide, zinc oxide, zinc carbonate, aluminum silicate, alumina hydrate, magnesium silicate, calcium silicate and silica, any of which may be used alone and also in combination. Pigments particularly preferable from the viewpoint of ink absorptivity and image suitability such as image resolution, include alumina hydrate, silica and calcium carbonate.

Alumina hydrate may be represented by the formula $Al_2O_3.nH_2O$; specifically, the alumina hydrate may be, for example, gibbsite, bayerite, nordstrandite, boehmite, diaspore or pseudoboehmite. Alumina hydrate, and in particular boehmite or pseudo-boehmite, (wherein n is from 1.0 to 2.0) is preferably used in the ink-jet recording material used in the present invention. The alumina hydrate, as described for example in EP patent application No. 636,489, can be produced by any conventional method such as the hydrolysis of aluminum alkoxide or sodium aluminate. Rocek, et al. [Collect Czech. Chem. Commun., Vol. 56, 1253-1262 (1991)] have reported that the pore structure of aluminum hydroxide is affected by deposition temperature, pH of the solution, aging time and surfactants used. The shape of the alumina hydrate can be in the form of a needle or in the form of a flat plate (as described in the literature by Rocek J., et al., Applied Catalysis, Vol. 74, 29-36 (1991), the latter being particularly preferred for the reasons that better dispersibility can be obtained and because the orientation of particles of the alumina hydrate in the form of a flat plate becomes random when forming an ink receiving layer, so that the range of the pore radius distribution widens. The average particle diameter of the alumina hydrate is preferably in the range from 10 to 200 nm, and more preferably from 50 to 150 nm. In the present invention, the ink receiving layer preferably comprises from 10 to 80 g/m$^2$, more preferably from 15 to 60 g/m$^2$ of alumina particles.

The silica may include natural silica, synthetic silica, amorphous silica, and chemically modified silica compounds, any of which may be used without any particular limitations, but particularly preferable is synthetic fine particulate silica with a specific surface area having preferably from 20 to 700 g/m$^2$ according to the BET method, and by use of the silica with such specific surface area, excellent color forming characteristic of the water-soluble dye in ink, optimum shape and size of ink dots can be accomplished. Silica particles are described, for example, in U.S. Pat. No. 5,612,281 and EP 813,978, which disclose ink-jet recording materials using synthetic silica fine particles prepared by a gas phase process, giving ultrafine particles having an average particle size from several nm to several tens nm, and having characteristics of giving high glossiness and high ink-absorption properties. A method for producing a positively charged colloidal silica sol is also disclosed, for example, in EP 1,112,962 and JP-B-47-26959, the method comprising coating the silica surface with alumina. By this method, it is possible to obtain a silica sol having the surface coated with alumina, which is excellent in transparency and stability. The content of silica should preferably be at least 10 wt %, more preferably at least 30 wt % in the ink receiving porous layer.

The calcium carbonate may include heavy calcium carbonate, light calcium carbonate and colloidal calcium carbonate, any of which may be used.

The binder to be used in the porous layer may be any known natural or synthetic resin binder, such as, for example, a hydrophilic binder, such as polyvinyl alcohol, silanol modified polyvinyl alcohol, polyvinyl pyrrolidone, polyvinyl acetate, oxidized starch, etherified starch, a cellulose derivative such as carboxymethyl cellulose or hydroxyethyl cellulose, casein, gelatin, acidic gelatin, soybean protein or, maleic anhydride resin, a copolymer latex of conjugated diene type such as a styrene-butadiene copolymer or a methylmethacrylate-butadiene copolymer; an acrylic polymer latex of acrylic type such as a polymer or a copolymer of acrylic ester or methacrylic ester, or a polymer or a copolymer of acrylic acid or methacrylic acid; a polymer latex of vinyl type such as an ethylene-vinyl acetate copolymer; a polymer latex of functional group modified type by a monomer containing functional groups such as a carboxyl group of such polymers; an aqueous adhesive of thermosetting synthetic resin such as an urea resin or a melamine resin; a synthetic resin type adhesive such as polymethyl methacrylate, a polyurethane resin, an unsaturated polyester resin, a vinyl chloride-vinyl acetate copolymer, a polyvinyl butyral or an alkyl resin. These binders may be used alone or in combination as a mixture. Preferred binder used in the ink receiving porous layer is polyvinyl alcohol.

The ink receiving porous layer preferably comprises from 0,1 to 10 g/m$^2$, more preferably from 2 to 8 g/m$^2$ of binder. The content of the binder is preferably from 1 to 50 parts by weight, and more preferably from 2 to 25 parts by weight, per 100 parts by weight of the inorganic pigment particles present in the ink receiving porous layer.

The ink receiving porous layer can optionally comprise boric acid or borates. As the boric acid, not only orthoboric acid but also metaboric acid and hypoboric acid may be used. As the borates, soluble salts of these boric acids are preferably employed. Specifically, $Na_2B_4O_7 \cdot 10H_2O$, $NaBO_2 \cdot 4H_2O$, $K_2B_4O_7 \cdot 5H_2O$, $KBO_2$, $NH_4B_4O_9 \cdot 3H_2O$ and $NH_4BO_2$ may, for example, be mentioned.

The ink receiving porous layer preferably comprises from 0.05 to 5.0 g/m$^2$, more preferably from 0.1 to 2.0 g/m$^2$ of boric acid or borate.

The ink receiving porous layer can comprise other surfactants in addition to those of the present invention, such as, for example, anionic surfactants, cationic surfactants, amphoteric surfactants, non-ionic surfactants, and fluorinated surfactants. Preferred surfactants are non-ionic and fluorinated surfactants, such as, for example, Triton™X-100, Zonyl™FSN, Fluorad™FC-170C, e Fluorad™ FC-171.

In addition, dispersant agents, thickening agents, pH adjustor agents, lubricants, fluidity modifier agents, surface activators, waterproof agents, whitening agents, ultraviolet absorbing agents, and antioxidants, can be added to the ink receiving porous layer.

The support used in the ink-jet recording material of the invention includes any conventional support for ink jet recording sheet. A transparent or opaque support can be used according to the final use of the ink jet recording sheet. Any conventional transparent support, such as a film or plate of polyester resins, cellulose acetate resins, acryl resins, polycarbonate resins, polyvinyl chloride resins, poly(vinylacetals), polyethers, polysulfonamides, polyamide resins, polyimide resins, cellophane or celluloid and a glass plate can be used. Any conventional opaque support such as paper, coat paper, synthetic paper, resin-covered paper, pigment-containing opaque film or foaming film can be used. The thickness of the support is preferably from 10 to 200 micrometer.

The support may be subjected to a surface treatment such as a corona discharge treatment for improving its adhesiveness to the layers coated thereon, or provided with a layer improving its adhesion, such as a subbing layer. Further, a curl-preventing layer such as a resin layer or a pigment layer may be provided on the back surface of the support or at a desired position thereof to prevent curling.

A non-porous layer can be optionally coated on the support as an interlayer between the support and the porous layer. The non-porous layer comprises a binder, at least one surfactant, and optionally, dispersant agents, thickening agents, pH adjustor agents, lubricants, fluidity modifier agents, surface activators, waterproof agents, whitening agents, ultraviolet absorbing agents, antioxidants, and hardening agents.

The binder of the non-porous layer may be chosen from the list of the binders cited above to be used in the ink receiving porous layer. Preferred binders used in the non-porous layer are gelatin, polyvinyl alcohol and polyvinylpyrrolidone.

Useful surfactants to be used in the ink receiving non-porous layer may be chosen from the list of the surfactants cited above to be used in the ink receiving porous layer. The preferred surfactants are nonionic and fluorinated surfactants, such as, for example, Triton™X-100, Zonyl™FS-300, Fluorad™FC-170C, and Fluorad™FC-171.

Any conventional coating process can be used to coat the porous layer (and, optionally, the non-porous layer) on the support, such as, for example, the air-knife coating system, the blade coating system, the roll coating system, the brush coating system, the gravure coating system, the bar coating system, the extrusion coating system, the slide coater system, the curtain coating system, or the like. The extrusion coating system and the slide coating system are particularly preferred to obtain by one pass a coating of proper and uniform thickness. In particular, a slide coater, as described, for example, in U.S. Pat. No. 2,761,419, is a multilayer die composed of a pack of elements, where distribution cavities are formed between each pair of elements. Coating liquids are laterally or centrally fed in the distribution cavities and uniformly spread through a slot, at which end they flow down an inclined plane, stacking in a multilayer stack. At the end of the slide, at a short distance from the edge (about 100-500 microns), the liquid meets and coats the moving web.

The following examples will describe in particular the advantages of the present invention over the prior art.

EXAMPLES

Emulsion Preparation

The comparison emulsions from 1 to 6 and the invention emulsions from 7 to 17 were prepared by mixing in a dispersing apparatus the ingredients reported in the following Table 1 (all values expressed in grams). The emulsions so obtained were then examined to measure the average diameter of the particles of the dispersion and their stability over time. The Malvern LoC apparatus bed on PCS (Photon Correlation Spectroscopy) system has been used to measure emulsions with particles having diameter lower than 300 nm. The Malvern Mastersizer apparatus based on the laser diffraction system has been used to measure emulsions with particles having diameter higher than 300 nm. The evaluation of stability has been made by measuring over time the increase of average particle size.

The results summarized in Table 1 demonstrated that optimal stability values (higher than 24 hours, preferably higher than 48 hours) and average particle size (lower than 300 nm) could be obtained only using in combination the Hostapur SAS alkylsulfonate anionic surfactant, and the Span 20 sorbitol monolaurate surfactant.

TABLE 1

| | 1 | 2 | 3 | 4 | 5 | 6 | 7 | 8 | 9 |
|---|---|---|---|---|---|---|---|---|---|
| Composition | | | | | | | | | |
| Tinuvin 144 | 4.00 | 4.00 | 4.00 | 4.00 | 4.00 | 4.00 | 4.00 | 4.00 | 4.00 |
| Irganox 1035 | | | | | | | | | |
| Irganox 1520L | | | | | | | | | |
| Irganox 565 | | | | | | | | | |
| Irganox 1081 | | | | | | | | | |
| A-3880 | | | | | | | | | |
| N-butyl-N-phenylacetamide | 4.00 | 4.00 | 2.00 | 2.00 | 2.00 | 2.00 | 2.00 | 2.00 | 2.00 |
| 2-sec-butylphenol | | | | | | | | | |
| Tributylfosfate | | | | | | | | | |
| Diisopropyl adipate | | | | | | | | | |
| Compound F-1 | 4.00 | 4.00 | 4.00 | 4.00 | 4.00 | 4.00 | 4.00 | 4.00 | 4.00 |
| Hostapur SAS | | | | | | 0.24 | 0.24 | 0.48 | 0.36 |
| Span 20 | | 2.50 | 0.85 | 1.20 | | | 1.50 | 2.00 | 1.00 |
| Pluronic L44 | 0.24 | 0.24 | | | | | | | |
| Tween 20 | | | 1.65 | | | | | | |
| Span 60 | | | | | 4.90 | | | | |
| Tween 60 | | | | | 7.40 | | | | |
| POE(80)SML | | | | 1.28 | | | | | |
| Celvol 523 | 3.60 | 3.60 | 3.60 | 3.60 | 3.60 | 3.60 | 3.60 | 3.60 | 3.60 |
| Ethyl acetate | 10 | 10 | 10 | 10 | 10 | 10 | 10 | 10 | 10 |
| Water to make (ml) | 100 | 100 | 100 | 100 | 100 | 100 | 100 | 100 | 100 |
| Results | | | | | | | | | |
| Average diameter (nm) | 370 | 300 | 264 | 380 | — | 230 | 220 | 230 | 290 |
| Stability (h) | >48 | <24 | <6 | <24 | — | <24 | >48 | >24 | >48 |

| | 10 | 11 | 12 | 13 | 14 | 15 | 16 | 17 |
|---|---|---|---|---|---|---|---|---|
| Composition | | | | | | | | |
| Tinuvin 144 | 4.00 | 4.00 | 4.00 | 4.00 | 4.00 | 4.00 | 4.00 | 4.00 |
| Irganox 1035 | 2.00 | | | | | | | |
| Irganox 1520L | | | | | 2.00 | | | |
| Irganox 565 | | | | | | 2.00 | | |
| Irganox 1081 | | | | | | | 2.00 | |
| A-3880 | | | | | | | | 2.00 |
| N-butyl-N-phenylacetamide | 2.00 | | | | 2.00 | 2.00 | 2.00 | 2.00 |
| 2-sec-butylphenol | | 2.00 | | | | | | |
| Tributylfosfate | | | | 2.00 | | | | |
| Diisopropyl adipate | | | 2.00 | | | | | |
| Compound F-1 | 4.00 | 4.00 | 4.00 | 4.00 | 4.00 | 4.00 | 4.00 | 4.00 |
| Hostapur SAS | 0.24 | 0.24 | 0.24 | 0.24 | 0.24 | 0.24 | 0.24 | 0.24 |
| Span 20 | 1.50 | 1.50 | 1.50 | 1.50 | 1.50 | 1.50 | 1.50 | 1.50 |
| Pluronic L44 | | | | | | | | |
| Tween 20 | | | | | | | | |
| Span 60 | | | | | | | | |
| Tween 60 | | | | | | | | |
| POE(80)SML | | | | | | | | |
| Celvol 523 | 3.60 | 3.60 | 3.60 | 3.60 | 3.60 | 3.60 | 3.60 | 3.60 |
| Ethyl acetate | 10 | 10 | 10 | 10 | 10 | 10 | 10 | 10 |
| Water to make (ml) | 100 | 100 | 100 | 100 | 100 | 100 | 100 | 100 |
| Results | | | | | | | | |
| Average diameter (nm) | 241 | 240 | 260 | 243 | 220 | 230 | 220 | 220 |
| Stability (h) | >48 | >48 | >24 | >48 | >48 | >48 | >48 | >48 |

Additional emulsions 18 to 23 were prepared by mixing in a dispersing apparatus the ingredients reported in the following Table 1A (all values expressed in grams except where specified different).

TABLE 1A

| Composition | 18 | 19 | 20 | 21 | 22 | 23 |
|---|---|---|---|---|---|---|
| Tinuvin 144 | 4.00 | 4.00 | 4.00 | 4.00 | 2.00 | 1.00 |
| Irganox 565 | | 2.00 | | | 2.00 | |
| Tinuvin 343 | | | 2.00 | | | |
| Tinuvin 123 | | | | 4.00 | 2.00 | 3.00 |
| N-butyl-N-phenylacetamide | 1.80 | 1.80 | 1.80 | 1.80 | 1.80 | 1.80 |
| Compound F-2 | 3.00 | 3.00 | 3.00 | 3.00 | 1.50 | 0.75 |
| Hostapur SAS | 0.20 | 0.20 | 0.24 | 0.24 | 0.24 | 0.24 |
| Span 20 | 1.00 | 1.00 | 1.00 | 1.00 | 1.00 | 1.00 |
| Celvol 523 | 3.60 | 3.60 | 3.60 | 3.60 | 3.60 | 3.60 |
| Ethyl acetate | 10 | 10 | 10 | 10 | 10 | 10 |
| Water to make (ml) | 100 | 100 | 100 | 100 | 100 | 100 |

Sample Preparation

Sample 1 (reference). An ink-jet recording material was obtained by slide coating on a support of resin coated paper a porous layer comprising, as dry coverage per square meter, 41.17 g of Disperal™HP14 (an alumina hydrate manufactured by Condea Gmbh, Hamburg, Germany), 4.09 g of Celvol™523 (a polyvinyl alcohol manufactured by Celanese A G, Kronberg/Taunus, Germany, having a saponification degree of 88%, and a polymerization degree of 1,500), 1.72 g of acetic acid, 1.41 g of boric acid, 0.14 g of Triton™X-100 (a non-ionic surfactant available from Union Carbide Co., Danbury, Conn.), 0.030 g of Zonyl™FS-300 (a non-ionic fluorinated surfactant manufactured by DuPont Specialty Chemicals, Wilmington, Del.) and 0.06 g of polymethylmethacrylate matting agent. The wet resulting coating was dried and the resulting ink receiving porous material prepared in roll was converted in A4 samples.

Sample 2 (comparison) was prepared as Sample 1, but the preparation used to get the porous layer of Sample 1 was mixed to the emulsion 1 before coating in order to obtain a porous layer comprising, as dry coverage per square meter, 1.2 g of Tinuvin 144 (available from Ciba Specialty Chemicals Inc, Basel, Switzerland), 1.2 g of N-butyl-N-phenylacetamide, 1.2 g of compound F-1, 0,072 g of Pluronic L44 (a block copolymer PEO/PPO, BASF, Pasippany, N.J.), 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100 (a non-ionic fluorinated surfactant manufactured by DuPont Specialty Chemicals, Wilmington, Del.).

Sample 3 (comparison) was prepared as Sample 2, but emulsion 1 was replaced by emulsion 6 and the resulting porous layer comprised, as dry coverage per square meter, 1.2 g of Tinuvin 144, 0.6 g of N-butyl-N-phenylacetamide, 1.2 g of compound F-1, 0,072 g of Hostapur (an alkylsulfonate surfactant, CLARIANT, Switzerland), 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 4 (invention) was prepared as Sample 2, but emulsion 1 was replaced by emulsion 7 and the resulting porous layer comprised, as dry coverage per square meter, 1.2 g of Tinuvin 144, 0.6 g of N-butyl-N-phenylacetamide, 1.2 g of compound F-1, 0,072 g of Hostapur, 0.45 g of Span 20 (sorbitolmonolaurate), 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 5 (invention) was prepared as Sample 2, but emulsion 1 was replaced by emulsion 11 and the resulting porous layer comprised, as dry coverage per square meter, 1.2 g of Tinuvin 144, 0.6 g of 2-sec-butyl-phenol, 1.2 g of compound F-1, 0,072 g of Hostapur, 0.45 g of Span 20, 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 6 (invention) was prepared as Sample 2, but emulsion 1 was replaced by emulsion 12 and the resulting porous layer comprised, as dry coverage per square meter, 1.2 g of Tinuvin 144, 0.6 g of diisopropyladipate, 1.2 g of compound F-1, 0,072 g of Hostapur, 0.45 g of Span 20, 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 7 (invention) was prepared as Sample 2, but emulsion 1 was replaced by emulsion 13 and the resulting porous layer comprised, as dry coverage per square meter, 1.2 g of Tinuvin 144, 0.6 g of tributylphosphate, 1.2 g of compound F-1, 0,072 g of Hostapur, 0.45 g of Span 20, 3.00 g of ethylacetate, 41.17 g of Disperal™HP 14, 5.17 g of Celvol™523, 1.72 g of acetic acid, 1.41 g of boric acid, 0.14 g of Triton™X-100, and 0.030 g of Zonyl™FSN-100.

Sample 8 (invention) was prepared as Sample 2, but emulsion 1 was replaced by emulsion 14 and the resulting porous layer comprised, as dry coverage per square meter, 1.2 g of Tinuvin 144 (available from Ciba Specialty Chemicals Inc, Basel, Switzerland), 0.6 g of N-butyl-N-phenylacetamide, 1.2 g of compound F-1, 0.6 g of Irganox 1520L, 0,072 g of Hostapur, 0.45 g of Span 20, 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 9 (invention) was prepared as Sample 2, but emulsion 1 was replaced by emulsion 15 and the resulting porous layer comprised, as dry coverage per square meter, 1.2 g of Tinuvin 144, 0.6 g of N-butyl-N-phenylacetamide, 1.2 g of compound F-1, 0.6 g of Irganox 565, 0,072 g of Hostapur, 0.45 g of Span 20, 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 10 (invention) was prepared as Sample 2, but emulsion 1 was replaced by emulsion 16 and the resulting porous layer comprised, as dry coverage per square meter, 1.2 g of Tinuvin 144, 0.6 g of N-butyl-N-phenylacetamide, 1.2 g of compound F-1, 0.6 g of Irganox 1081, 0,072 g of Hostapur, 0.45 g of Span 20, 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 11 (invention) was prepared as Sample 2, but emulsion 1 was replaced by emulsion 17 and the resulting porous layer comprised, as dry coverage per square meter, 1.2 g of Tinuvin 144, 0.6 g of N-butyl-N-phenylacetamide, 1.2 g of compound F-1, 0.6 g of A-3880, 0,072 g of Hostapur, 0.45 g of Span 20, 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 12 (invention) was prepared as Sample 2, but emulsion 1 was replaced by emulsion 18 and the resulting porous layer comprised, as dry coverage per square meter, 1.2 g of Tinuvin 144, 0.54 g of N-butyl-N-phenylacetamide, 0.9 g of compound F-2, 0,060 g of Hostapur, 0.30 g of Span 20 (sorbitolmonolaurate), 3.00 g of ethylacetate, 41.17 g of Disperal™14, 5.17 g of Celvol™523, 1.72 g of acetic acid, 1.41 g of boric acid, 0.14 g of Triton™X-100, and 0.030 g of Zonyl™FSN-100.

Sample 13 (invention) was prepared as Sample 2, but emulsion 1 was replaced by emulsion 19 and the resulting porous layer comprised, as dry coverage per square meter, 1.2 g of Tinuvin 144, 0.60 g of Irganox 565, 0.54 g of N-butyl-N-phenylacetamide, 0.9 g of compound F-2, 0,060 g of Hostapur, 0.30 g of Span 20 (sorbitolmonolaurate), 3.00 g of ethylacetate, 41.17 g of Disperal™HP 14, 5.17 g of Celvol™523, 1.72 g of acetic acid, 1.41 g of boric acid, 0.14 g of Triton™X100, and 0.030 g of Zonyl™FSN-100.

Sample 14 (invention) was prepared as Sample 2, but emulsion 1 was replaced by emulsion 20 and the resulting porous layer comprised, as dry coverage per square meter, 1.2 g of Tinuvin 144, 0.60 g of Tinuvin 343, 0.54 g of N-butyl-N-phenylacetamide, 0.9 g of compound F-2, 0,072 g of Hostapur, 0.30 g of Span 20 (sorbitolmonolaurate), 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 15 (invention) was prepared as Sample 2, but emulsion 1 was replaced by emulsion 21 and the resulting porous layer comprised, as dry coverage per square meter, 1.2 g of Tinuvin 144, 1.2 g of Tinuvin 123, 0.54 g of N-butyl-N-phenylacetamide, 0.90 g of compound F-2, 0,072 g of Hostapur, 0.30 g of Span 20 (sorbitolmonolaurate), 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 16 (invention) was prepared as Sample 2, but emulsion 1 was replaced by emulsion 22 and the resulting porous layer comprised, as dry coverage per square meter, 0.6 g of Tinuvin 144, 0.6 g of Tinuvin 123, 0.60 g of Irganox 565, 0.54 g of N-butyl-N-phenylacetamide, 0.45 g of compound F-2, 0,072 g of Hostapur, 0.30 g of Span 20 (sorbitolmonolaurate), 3.00 g of ethylacetate, 41.17 g of Disperal™HP14, 5.17 g of Celvol™523, 1.72 g of acetic acid, 1.41 g of boric acid, 0.14 g of Triton™X-100, and 0.030 g of Zonyl™FSN-100.

Sample 17 (invention) was prepared as Sample 2, but emulsion 1 was replaced by emulsion 23 and the resulting porous layer comprised, as dry coverage per square meter, 0.3 g of Tinuvin 144, 0.9 g of Tinuvin 123, 0.54 g of N-butyl-N-phenylacetamide, 0.225 g of compound F-2, 0,072 g of Hostapur, 0.30 g of Span 20 (sorbitolmonolaurate), 3.00 g of ethylacetate, 41.17 g of Disperal™HP14, 5.17 g of Celvol™523, 1.72 g of acetic acid, 1.41 g of boric acid, 0.14 g of Triton™X100, and 0.030 g of Zonyl™FSN-100.

The formulas of the antifading compounds used in the above mentioned examples are reported hereinbelow.

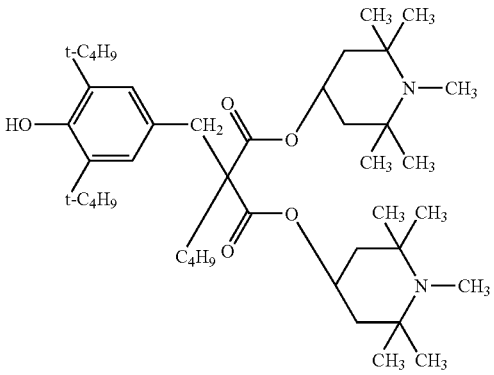

Tinuvin 144

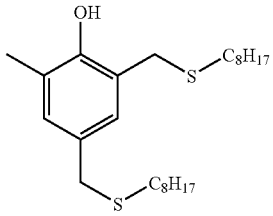

Irganox 1520 L

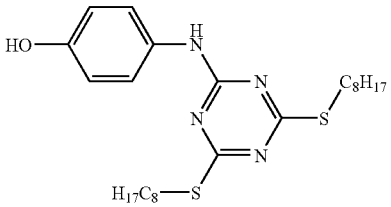

Irganox 565

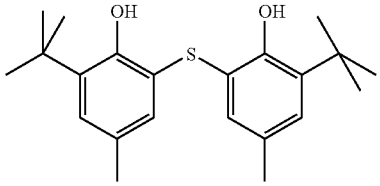

Irganox 1081

-continued

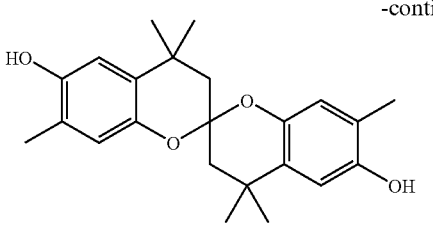

A-3880

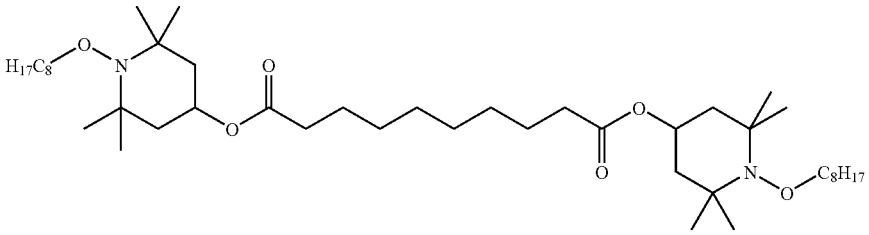

Tinuvin 123

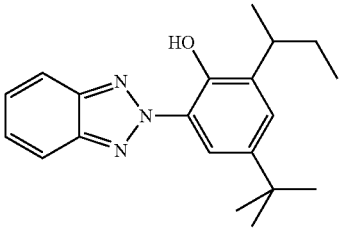

Tinuvin 343

The following Table 2 summarizes the resulting dry content of organic solvent, antifading agent, non-ionic surfactant, anionic surfactant, and carboxylic derivative in each of the above described samples 1 to 17. All values are expressed as $g/m^2$.

TABLE 2

| Material | Emulsion | Solvent | Anti-fading agent | Non-ionic sur-factant | Anionic sur-factant | Car-boxylic de-rivative |
|---|---|---|---|---|---|---|
| Sample 1 Reference | — | — | — | — | — | — |
| Sample 2 Comparison | 1 | 1.20 | 1.2 | 0.072 | — | 1.20 |
| Sample 3 Comparison | 6 | 0.60 | 1.2 | — | 0.072 | 1.20 |
| Sample 4 Invention | 7 | 0.60 | 1.2 | 0.45 | 0.072 | 1.20 |
| Sample 5 Invention | 11 | 0.60 | 1.2 | 0.45 | 0.072 | 1.20 |
| Sample 6 Invention | 12 | 0.60 | 1.2 | 0.45 | 0.072 | 1.20 |
| Sample 7 Invention | 13 | 0.60 | 1.2 | 0.45 | 0.072 | 1.20 |
| Sample 8 Invention | 14 | 0.60 | 1.8 | 0.45 | 0.072 | 1.20 |
| Sample 9 Invention | 15 | 0.60 | 1.8 | 0.45 | 0.072 | 1.20 |
| Sample 10 Invention | 16 | 0.60 | 1.8 | 0.45 | 0.072 | 1.20 |
| Sample 11 Invention | 17 | 0.60 | 1.8 | 0.45 | 0.072 | 1.20 |
| Sample 12 Invention | 18 | 0.54 | 1.2 | 0.30 | 0.060 | 0.90 |

TABLE 2-continued

| Material | Emulsion | Solvent | Anti-fading agent | Non-ionic sur-factant | Anionic sur-factant | Car-boxylic de-rivative |
|---|---|---|---|---|---|---|
| Sample 13 Invention | 19 | 0.54 | 1.8 | 0.30 | 0.060 | 0.90 |
| Sample 14 Invention | 20 | 0.54 | 1.8 | 0.30 | 0.072 | 0.90 |
| Sample 15 Invention | 21 | 0.54 | 2.4 | 0.30 | 0.072 | 0.90 |
| Sample 16 Invention | 22 | 0.54 | 1.8 | 0.30 | 0.072 | 0.45 |
| Sample 17 Invention | 23 | 0.54 | 1.2 | 0.30 | 0.072 | 0.225 |

The fresh samples 1 to 17 were subjected to the glossiness test by measuring the reflected light at an angle of 20° and 60° with a TRI-Microgloss-160 (Sheen Instruments Ltd., Kingston-Upon-Thames, Surrey, UK), as described in ASTM specification No. 523. Then, another set of samples 1 to 14 was printed with an Epson 915 printer. After printing, each sample was subjected to the following tests.

The drying to touch test was done by evaluating the ink smudge resulting from touching with a finger the ink immediately after printing. The ink bleeding test was made by printing a pattern of multiple strips having several different colors and by visually evaluating the color interdiffusion. The mottle test was made by visually inspecting the samples. Samples that showed formation of bands in addition to mottles were considered even worst. The band formation is defined as the occurrence of dark bands of ink between printed strips. The bronzing test was made by visually inspecting the samples and verifying the presence (or the absence) of ink crystallization on the surface. The surface ink crystallization promotes the bronzing of the observed color.

Each printed sample was subjectively evaluated with a score ranging from 1 to 5, where 1 is the worst score and 5 is the best score. The results were summarized in the following Table 3.

TABLE 3

| | lossinessG | | Drying | | | |
|---|---|---|---|---|---|---|
| Material | 20° | 60° | time | Mottle | Bleeding | Bronzing |
| Sample 1 Reference | 17 | 43 | 5 | 5 | 5 | 5 |
| Sample 2 Comparison | 3.4 | 23 | 5 | 5 | 5 | 4 |
| Sample 3 Comparison | 3.2 | 20.7 | 5 | 5 | 5 | 4 |
| Sample 4 Invention | 13 | 37 | 4.5 | 4.5 | 4.5 | 4.5 |
| Sample 5 Invention | 14.2 | 41.5 | 4 | 4.5 | 4.5 | 4.5 |
| Sample 6 Invention | 9.9 | 35.1 | 4 | 4.5 | 4.5 | 4.5 |
| Sample 7 Invention | 9.2 | 32 | 4.5 | 4.5 | 4.5 | 4.5 |
| Sample 8 Invention | 10.4 | 36 | 4.5 | 4.5 | 4.5 | 4.5 |
| Sample 9 Invention | 10.5 | 35 | 4.5 | 4.5 | 4.5 | 4.5 |
| Sample 10 Invention | 11.8 | 36 | 4.5 | 4.5 | 4.5 | 4.5 |
| Sample 11 Invention | 11.9 | 37 | 4.5 | 4.5 | 4.5 | 4.5 |
| Sample 12 Invention | 20 | 46 | 5 | 5 | 5 | 4 |
| Sample 13 Invention | 19 | 43 | 5 | 5 | 5 | 4 |
| Sample 14 Invention | 13 | 43 | 5 | 5 | 5 | 4 |
| Sample 15 Invention | 20 | 44 | 5 | 5 | 5 | 4.5 |
| Sample 16 Invention | 21 | 45 | 5 | 5 | 5 | 4.5 |
| Sample 17 Invention | 22 | 46 | 5 | 5 | 5 | 4.5 |

Samples 4 to 17 of the present invention showed a coating quality and a glossiness comparable to those of reference Sample 1. Comparison samples 2 and 3, although showing good printing quality, did not allow to get optimal glossiness values.

Another set of samples 1 to 17 was printed and submitted to 8 incubation weeks to check the resistance of the image to air deterioration according to the following procedure. A solid image pattern including 7 colored patches (cyan, magenta, yellow, red, green, blue and black patches) was printed on the test sheet by a Deskjet 970 ink-jet printer (manufactured by Hewlett-Packard Co., Palo Alto, Calif.) with the original ink-jet cartridges made by Hewlett-Packard. The reflection density of recorded patches was measured for each single color cyan, magenta, yellow and for each component of the red, green, blue and black area with a TR 1224 densitometer (manufactured by Macbeth, a division of Kollmorgen Instrument Corp., Newburgh, N.Y.). The patch area exhibiting a density near 1.00 was selected for each single color cyan, magenta and yellow; on the other hand, for the red, green and blue composite colors, it was considered each respective two components to choose the respective density 1.00 area; finally, the three components to choose the respective density 1.00 area were considered for the black composite color. The samples were submitted to a 2 Klux intensity fluorescent light exposure, at 50% relative humidity and 23° C. The atmosphere air composition was maintained stable during all the test, in particular for the oxygen and $H_2S$, $SO_2$, $NO_2$ and $O_3$ gases present in little amounts. The recorded sample surface was maintained free of any physical protection to allow the natural air circulation. After incubation, the density was again measured for each selected area in which an initial density near 1.00 had been measured; consequently, the air oxidation resistance of the image could be evaluated. All invention samples showed an air oxidation resistance of the image equal to or higher than that of reference sample 2 and much higher than that of sample 1, free of antifading agent.

The invention claimed is:

1. An ink jet recording material comprising a support, and at least one ink receiving porous layer coated on the support, wherein said at least one porous layer comprises a) an organic solvent having a logP value higher than 2.00, b) an antifading compound, c) a non-ionic surfactant having low HLB, d) an anionic surfactant, and e) a carboxylic derivative, and wherein said organic solvent is a compound represented by any one of the following general formulas:

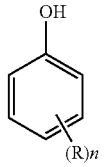

wherein R is a linear or branched alkyl group having from 1 to 10 carbon atoms, and n in an integer from 1 to 5;

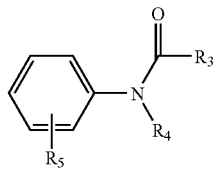

wherein $R_3$, $R_4$, and $R_5$,equal or different, are linear or branched alkyl groups having from 1 to 20 carbon atoms; and

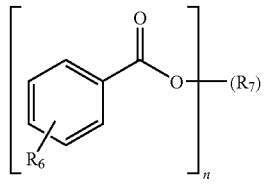

wherein $R_6$ is a linear or branched alkyl group having from 1 to 10 carbon atoms, $R_7$ is a n-valent linear or branched alkylene group having from 1 to 20 carbon atoms, and n is an integer from 2 to 4.

2. The ink jet recording material according to claim 1, wherein said organic solvent has a logP value in the range of from 2.00 to 9.00.

3. The ink jet recording material according to claim 1, wherein said organic solvent is selected from the group consisting of alkyl substituted phenols, esters of aromatic carboxylic acids with alcohols, esters of aromatic carboxylic acids and polyols, amides of aromatic carboxylic acid and aliphatic amines, and amides of aliphatic carboxylic acid and aromatic amines.

4. The ink-jet recording material according to claim 1, wherein said non-ionic surfactant having, low HLB has a HLB value equal to or lower than 10.

5. The ink jet recording material according to claim 4, wherein said non-ionic surfactant is chosen from the group consisting of polyoxyalkylene ethers and esters, alkylenoxide polymers and copolymers, hydroxyalkyl-alkylamines, and sorbitan derivatives.

6. The ink jet recording material according to claim 4, wherein said non-ionic surfactant is chosen from the group consisting of block copolymers PEO/PPO having a HLB of 1, 2, 4, 5 and 6-7; PEO (4) laurylether having a HLB of 9.7; PEO (2) cetylether having a HLB of 5.3; PEO (2) oleylether having a HLB of 4.9; PEO (2) stearylether having a HLB of 4.9; PEO (200) diolether having a HLB of 5.0; PEO (400) dioleate having a HLB of 8.5; PEO (400) stearate having a HLB of 8.8; sorbitol monolaurate having a HLB of 8.6; sorbitol monopalmitate having HLB of 6.7; sorbitol monostearate having a HLB of 4.7; sorbitol tristearate having a HLB of 2.1; sorbitol monooleate hacing a HLB of 4.3; sorbitol triol trioleate having a HLB of 1.8; bis(2-hydroxylethyl)soyaalkylamine having a HLB of 10.0; bis(2-hydroxyethyl)octadecylamine having a HLB of 9.8 and bis(2-hydroxyethyethyl)oleylamine having a HLB of 9.9.

7. The ink-jet recording material according to claim 1, wherein said anionic surfactant is chosen from the group consisting of alkylsulfates, alkylsulfonates, alkylarylsulfates, alkylarylsulfonates, arylalkylsulfates, arylalkylsulfonates, alkylensulfates, alkylensulfonates having a linear or branched hydrocarbon chain comprising from 8 to 32 carbon atoms.

8. The ink jet recording material according to claim 1, wherein said carboxylic derivative is represented by the following general formula:

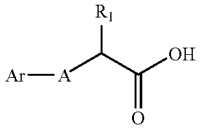

wherein $R_1$ represents hydrogen atom, or a linear or branched alkyl group having from 1 to 12 carbon atoms, A represents —O—, —S—or —$SO_2$—, and Ar represents an aryl group.

9. The ink jet recording material according to claim 1, wherein said carboxylic derivative is represented by the following formulas:

(F-1)

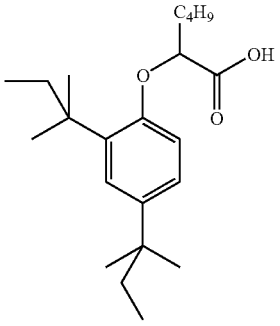

-continued (F-2)

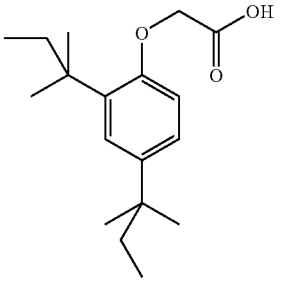

(F-3)

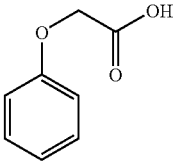

(F-4)

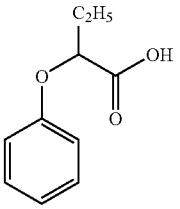

(F-5)

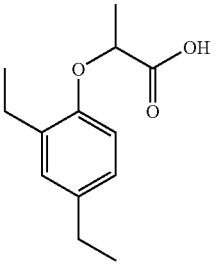

(F-6)

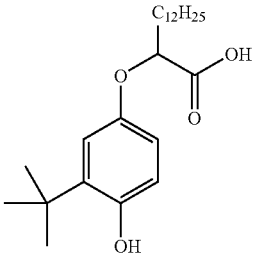

(F-7)

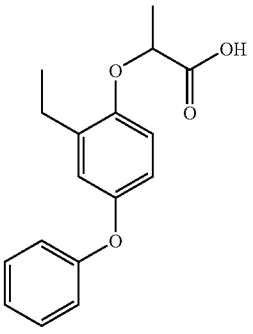

-continued (F-8)

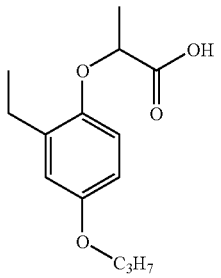

(F-9)

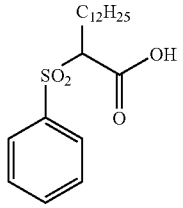

(F-10)

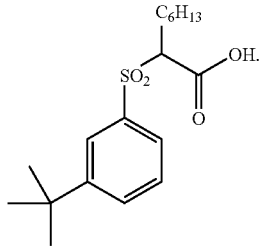

10. The ink jet recording material according to claim 1, wherein said color-fading inhibitor compound is represented by the following general formula I:

Formula I

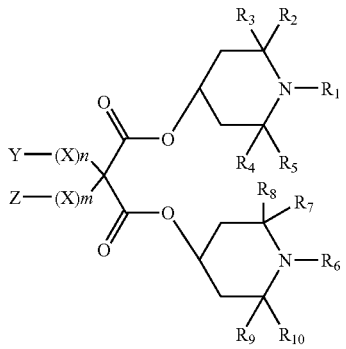

wherein $R_1$ to $R_{10}$, being the same or different, each is an alkyl group having from 1 to 5 carbon atoms; X is a divalent linking group; m and n, equal or different, are 0, 1 or 2; Z is Y or is an alkyl group, having from 1 to 12 carbon atoms, and Y is represented by formula II, Formula II

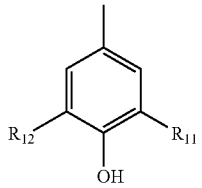

wherein $R_{11}$ and $R_{12}$ each being an alkyl group having from 1 to 6 carbon atoms.

11. The ink jet recording material according to claim 1, wherein said at least one ink receiving porous layer comprises an amount of said organic solvent in the range of from 0.1 to 20 g/m$^2$.

12. The ink jet recording material according to claim 1, wherein said at least one porous ink receiving layer comprises an amount of said non-ionic surfactant having low HLB in the range of from 0.1 to 1.0 g/m$^2$.

13. The ink jet recording material according to claim 1, wherein said at least one porous ink receiving layer comprises an amount of said anionic surfactant in the range of from 0.01 to 1.0 g/m$^2$.

14. The ink jet recording material according to claim 1, wherein said at least one porous ink receiving layer comprises an amount of said carboxylic derivative in the range of from 0.1 to 10.0 g/m$^2$.

15. The ink jet recording material according to claim 1, wherein said at least one porous ink receiving layer comprises an amount of said antifading agent in the range of from 0.1 to 10.0 g/m$^2$.

16. The ink jet recording material according to claim 1, wherein said at least one ink receiving porous layer comprises inorganic pigment fine particles and a binder.

17. The ink jet recording material according to claim 16, wherein said inorganic pigment fine particles are alumina particles or silica particles.

18. The ink jet recording material according to claim 16, wherein said binder is polyvinyl alcohol.

19. The ink jet recording material according to claim 1, wherein a non-porous layer is coated between said support and said at least one porous ink receiving layer.

20. The ink jet recording material according to claim 19, wherein said non-porous layer comprise a binder and a surfactant.

21. The ink jet recording material according to claim 20, wherein said binder is selected form the group consisting of gelatin, polyvinyl alcohol and polyvinylpyrrolidone.

22. An ink-jet recording material comprising a support, and at least one ink receiving porous layer coated on the support, wherein said at least one porous layer comprises a) an organic solvent having a logP value higher than 2.00, b) an antifading compound, c) a non-ionic surfactant having low HLB, d) an anionic surfactant, and e) a carboxylic derivative represented by the following general formula:

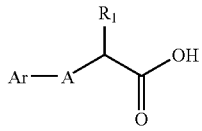

wherein $R_1$ represents hydrogen atom, or a linear or branched alkyl group having from 1 to 12 carbon atoms, A represents —O—, —S—or —$SO_2$—, and Ar represents an aryl group.

23. The ink-jet recording material according to claim 22, wherein said organic solvent has a logP value in the range of from 2.00 to 9.00.

24. The ink-jet recording material according to claim 22, wherein said organic solvent is selected from the group consisting of alkyl substituted phenols, esters of aromatic carboxylic acids with alcohols, esters of aromatic carboxylic acids and polyols, amides of aromatic carboxylic acid and aliphatic amines, and amides of aliphatic carboxylic acid and aromatic amines.

25. The ink-jet recording material according to claim 22, wherein said organic solvent is a compound represented by the following general formula:

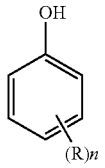

wherein R is a linear or branched alkyl group having from 1 to 10 carbon atoms, and n in an integer from 1 to 5.

26. The ink-jet recording material according to claim 22, wherein said organic solvent is a compound represented by the following general formula:

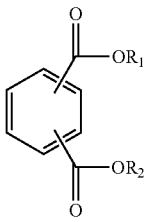

wherein $R_1$ and $R_2$, equal or different, are linear or branched alkyl groups having from 2 to 25 carbon atoms.

27. The ink-jet recording material according to claim 22, wherein said organic solvent is a compound represented by the following general formula:

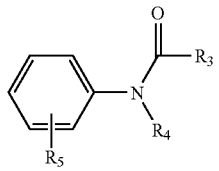

wherein $R_3$, $R_4$ and $R_5$, equal or different, are linear or branched alkyl groups having from 1 to 20 carbon atoms.

28. The ink-jet recording material according to claim 22, wherein said organic solvent is a compound represented by the following general formula:

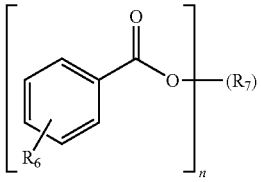

wherein $R_6$ is a linear or branched alkyl group having from 1 to 10 carbon atoms, $R_7$ is a n-valent linear or branched alkylene group having from 1 to 20 carbon atoms, and n is an integer from 2 to 4.

29. The ink-jet recording material according to claim 22, wherein said non-ionic surfactant having low HLB has a HLB value equal to or lower than 10.

30. The ink-jet recording material according to claim 29, wherein said non-ionic surfactant is chosen from the group consisting of polyoxyalkylene ethers and esters, alkyleneoxide polymers and copolymers, hydroxyalkyl-alkylamines, and sorbitan derivatives.

31. The ink-jet recording material according to claim 29, wherein said non-ionic surfactant is chosen from the group consisting of block copolymers PEO/PPO having a HLB of 1, 2, 4, 5 and 6-7; PEO (4) laurylether having a HLB of 9.7; PEO (2) cetylether having a HLB of 5.3; PEO (2) oleylether having a HLB of 4.9; PEO (2) stearylether having a HLB of 4.9; PEO(200) dioleate having a HLB of 5.0; PEO(400) dioleate having a HLB of 8.5; PEO(400) stearate having a HLB of 8.8; sorbitol monolaurate having a HLB of 8.6; sorbitol monopalmitate having a HLB of 6.7; sorbitol monostearate having a HLB of 4.7; sorbitol tristearate having a HLB of 2.1; sorbitol monooleate having a HLB of 4.3; sorbitol trioleate having a HLB of 1.8; bis(2-hydroxylethyl)soyaalkylamine having a HLB of 10.0; bis(2-hydroxyethyl)octadecylamine having a HLB of 9.8 and bis(2-hydroxyethyl)oleylamine having a HLB of 9.9.

32. The ink-jet recording material according to claim 22, wherein said anionic surfactant is chosen from the group consisting of alkylsulfates, alkylsulfonates, alkylarylsulfates, alkylarylsulfonates, arylalkylsulfates, arylalkylsulfonates, alkylensulfates, alkylensulfonates having a linear or branched hydrocarbon chain comprising from 8 to 32 carbon atoms.

33. The ink jet recording material according to claim 22, wherein said carboxylic derivative is represented by the following formulas:

(F-1)

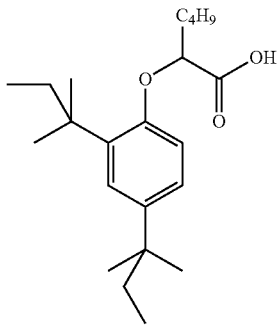

-continued (F-2)

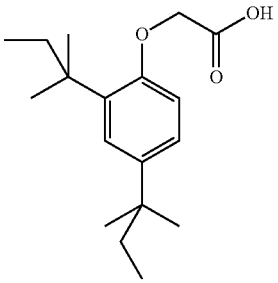

(F-3)

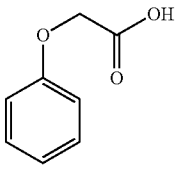

(F-4)

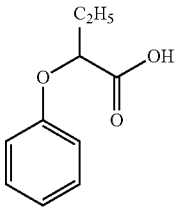

(F-5)

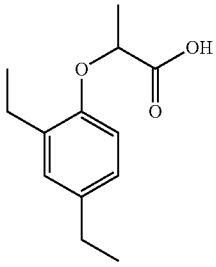

(F-6)

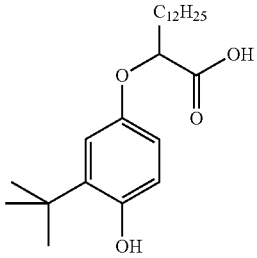

(F-7)

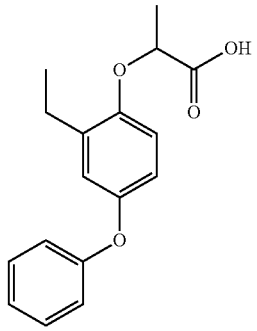

-continued (F-8)

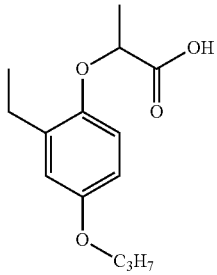

(F-9)

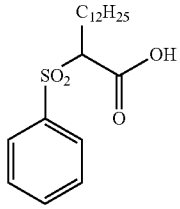

(F-10)

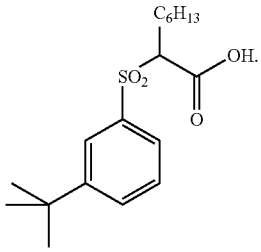

34. The inkjet recording material according to claim 22, wherein said color fading inhibitor compound is represented by the following general formula I:

Formula I

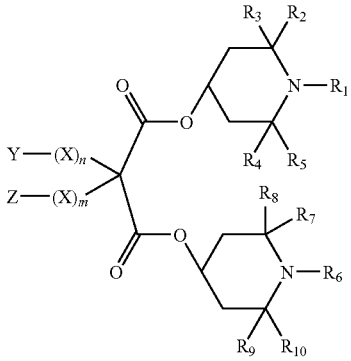

wherein $R_1$ to $R_{10}$, being the same or different, each is an alkyl group having from 1 to 5 carbon atoms; X is a divalent linking group; m and n, equal or different, are 0, 1 or 2; Z is Y or is an alkyl group having from 1 to 12 carbon atoms, and Y is represented by formula II,

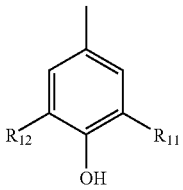

wherein $R_{11}$ and $R_{12}$ each being an alkyl group having from 1 to 6 carbon atoms.

35. The ink-jet recording material according to claim 22, wherein said at least one ink receiving porous layer comprises an amount of said organic solvent in the range of from 0.1 to 20 $g/m^2$.

36. The ink jet recording material according to claim 22, wherein said at least one porous ink receiving layer comprises an amount of said non-ionic surfactant having low HLB in the range of from 0.1 to 1.0 $g/m^2$.

37. The ink jet recording material according to claim 22, wherein said at least one porous ink receiving layer comprises an amount of said anionic surfactant in the range of from 0.01 to 1.0 $g/m^2$.

38. The ink jet recording material according to claim 22, wherein said at least one porous ink receiving layer comprises an amount of said carboxylic derivative in the range of from 0.1 to 10.0 $g/m^2$.

39. The ink-jet recording material according to claim 22, wherein said at least one porous ink receiving layer comprises an amount of said antifading agent in the range of from 0.1 to 10.0 $g/m^2$.

40. The ink jet recording material according to claim 22, wherein said at least one ink receiving porous layer comprises inorganic pigment fine particles and a binder.

41. The ink-jet recording material according to claim 40, wherein said inorganic pigment fine particles are alumina particles or silica particles.

42. The ink-jet recording material according to claim 40, wherein said binder is polyvinyl alcohol.

43. The ink-jet recording material according to claim 22, wherein a non-porous layer is coated between said support and said at least one porous ink receiving layer.

44. The ink-jet recording material according to claim 43, wherein said non-porous layer comprises a binder and a surfactant.

45. The ink-jet recording material according to claim 44, wherein said binder is selected form the group consisting of gelatin, polyvinyl alcohol and polyvinylpyrrolidone.

* * * * *